US009404467B2

(12) United States Patent
Shiraishi et al.

(10) Patent No.: US 9,404,467 B2
(45) Date of Patent: Aug. 2, 2016

(54) IGNITION DEVICE FOR INTERNAL COMBUSTION ENGINE AND IGNITION METHOD

(71) Applicant: NISSAN MOTOR CO., LTD., Yokohama-shi, Kanagawa (JP)

(72) Inventors: Taisuke Shiraishi, Kawasaki (JP); Kazuhisa Watanabe, Machida (JP); Shinichi Okamoto, Yokohama (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 14/760,909

(22) PCT Filed: Nov. 18, 2013

(86) PCT No.: PCT/JP2013/080989
§ 371 (c)(1),
(2) Date: Jul. 14, 2015

(87) PCT Pub. No.: WO2014/112197
PCT Pub. Date: Jul. 24, 2014

(65) Prior Publication Data

US 2015/0369202 A1 Dec. 24, 2015

(30) Foreign Application Priority Data

Jan. 18, 2013 (JP) ..... 2013-006893

(51) Int. Cl.
*F02P 15/10* (2006.01)
*F02P 3/045* (2006.01)
(Continued)

(52) U.S. Cl.
CPC ..... *F02P 3/0453* (2013.01); *F02P 3/055* (2013.01); *F02P 9/002* (2013.01); *F02P 15/10* (2013.01); *F02P 3/0554* (2013.01)

(58) Field of Classification Search
CPC ..... F02P 3/045; F02P 3/0453; F02P 3/0456; F02P 3/05; F02P 3/051; F02P 3/055; F02P 3/0552; F02P 3/0554; F02P 15/08; F02P 15/10; F02P 9/002
USPC ..... 123/621, 622, 609
See application file for complete search history.

(56) References Cited

U.S. PATENT DOCUMENTS 4,280,461 A * 7/1981 Okuda ..... F02P 5/155 123/609
4,293,798 A * 10/1981 Gerry ..... F02P 3/01 123/620

(Continued)

FOREIGN PATENT DOCUMENTS

JP 59-103968 A 6/1984
JP 63-129167 A 6/1988

(Continued)

*Primary Examiner* — Thomas Moulis
(74) *Attorney, Agent, or Firm* — Foley & Lardner LLP

(57) ABSTRACT

An ignition unit (11) has a superimposed voltage generation circuit (17) that feeds, between electrodes of an ignition plug (9), a superimposed voltage of the same direction as a discharge voltage, and in an operation range wherein an engine rotation speed is equal to or lower than a given speed and an engine load is equal to or lower than a given load, feeding of the superimposed voltage is carried out. Although the energization time for a primary coil (15*a*) is basically set in accordance with the engine rotation speed, the energization time TDWLON for the superimposed voltage feeding is set shorter than the energization time TDWLOFF for the superimposed voltage non-feeding. With this, temperature increase of the ignition unit (11) caused by the feeding of the superimposed voltage is suppressed.

8 Claims, 13 Drawing Sheets

(51) Int. Cl.
*F02P 9/00* (2006.01)
*F02P 3/055* (2006.01)

(56) References Cited

U.S. PATENT DOCUMENTS 4,411,246 A * 10/1983 Sugiura ..... F02P 3/0453 123/609
6,935,323 B2 * 8/2005 Waters ..... F02P 3/051 123/594

FOREIGN PATENT DOCUMENTS

JP 1-177455 A 7/1989
JP 2554568 B2 11/1996
JP 9-324731 A 12/1997
JP 2000-257541 A 9/2000
JP 2009-68443 A 4/2009
JP 2009-215902 A 9/2009
JP 2012-136965 A 7/2012

* cited by examiner

IGNITION DEVICE FOR INTERNAL COMBUSTION ENGINE AND IGNITION METHOD

TECHNICAL FIELD

The present invention relates to an ignition device for an internal combust engine that includes a primary coil and a secondary coil and further relates to an ignition method.

BACKGROUND ART

In an ignition device including an ignition coil, by, after feeding a primary coil with a primary current, cutting off the primary current at a predetermined ignition timing, a high discharge voltage is produced in a secondary coil causing an ignition plug connected to the secondary coil to produce an electric discharge between electrodes of the ignition plug. The discharge voltage and discharge energy produced in the secondary coil basically depend on an energization time for the primary coil.

In Patent Document-1, there is disclosed a technology in which in order to obtain an assured ignition by elongating the discharge period, a superimposed voltage produced by a different booster is fed to the ignition plug during the discharge period after the ignition timing. In this technology, after starting the discharge between the electrodes by the secondary voltage produced by the ignition coil, a discharge current is continued by the superimposed voltage and thus, much larger energy is given to an air/fuel mixture.

In general, the energization time for the primary coil that controls the discharge energy is determined by a rotation speed of the engine, and when the engine rotation speed is low, the energization time needed becomes long. However, in Patent Document-2, there is disclosed a technology in which in a higher load operation range, the energization time is increased and in a lower load operation range, the energization time is reduced.

Although feeding of the superimposed voltage like in the technology disclosed by Patent Document-1 is effective for improving ignition performance, the feeding has such a drawback that due to a heat generation of a superimposed voltage generation circuit in an ignition unit including the ignition coil, the ignition unit is subjected to a temperature increase. Particularly, in a higher engine rotation speed range, the temperature increase of the ignition unit is remarkable, and thus, in such higher engine rotation speed range, feeding of the superimposed voltage can't be used or it is necessary to provide the ignition unit with a high heat resistance.

Patent Document-2 shows only an example in which the energization time for the primary coil is changed between the higher load operation range and the lower load operation range, and the publication does not prepare any description on the temperature increase of the ignition unit.

PRIOR ART DOCUMENTS

Patent Documents

Patent Document-1: Japan Patent 2554568

Patent Document-2: Japan Laid-open Patent Application (tokkai) 2012-136965

SUMMARY OF INVENTION

An object of the present invention is to improve an ignition performance by feeding a superimposed voltage while suppressing temperature increase of an ignition unit.

In accordance with the present invention, there is provided an ignition device of an internal combustion engine that produces a discharge voltage between electrodes of an ignition plug connected to a secondary coil of an ignition coil by feeding and cutting off a primary current to a primary coil of the ignition coil, which comprises a superimposed voltage generation circuit that continues a discharge current by, after starting the discharge by the secondary coil, feeding between the electrodes of the ignition plug a superimposed voltage of the same direction as the discharge voltage; wherein under a given operation condition of an engine, the feeding of the superimposed voltage by the superimposed voltage generation circuit is carried out; and wherein an energization time for the primary coil set in accordance with an engine rotation speed is relatively shortened when the feeding of the superimposed voltage is carried out as compared with the energization time set when the feeding of the superimposed voltage is not carried out.

As is mentioned hereinabove, by shortening the energization time for the primary coil at the time when the feeding of the superimposed voltage is carried out, temperature increase of the ignition unit is suppressed. The energization time for the primary coil correlates with a discharge voltage produced by the secondary coil as well as a discharge energy. However, in case of carrying out the superimposed voltage feeding, since the discharge current is continued by the feeding of the superimposed voltage after starting of the discharge, it is only necessary to provide a discharge voltage that is able to induce an insulation breakdown between the electrodes of the ignition plug.

The temperature increase of the ignition unit becomes a problem especially in a higher engine speed range, and thus, if desired, the energization time for the primary coil may be shortened only in a higher engine rotation speed side of the engine rotation speed and engine load range during which the superimposed voltage feeding is carried out.

In accordance with the invention, due to feeding of the superimposed voltage, the ignition performance can be increased and at the same time, excessive temperature increase of the ignition unit caused by the feeding of the superimposed voltage can be avoided.

EMBODIMENTS FOR CARRYING OUT INVENTION

In the following, embodiments of the present invention will be described in detail with reference to the accompanying drawings.

Figure 1:
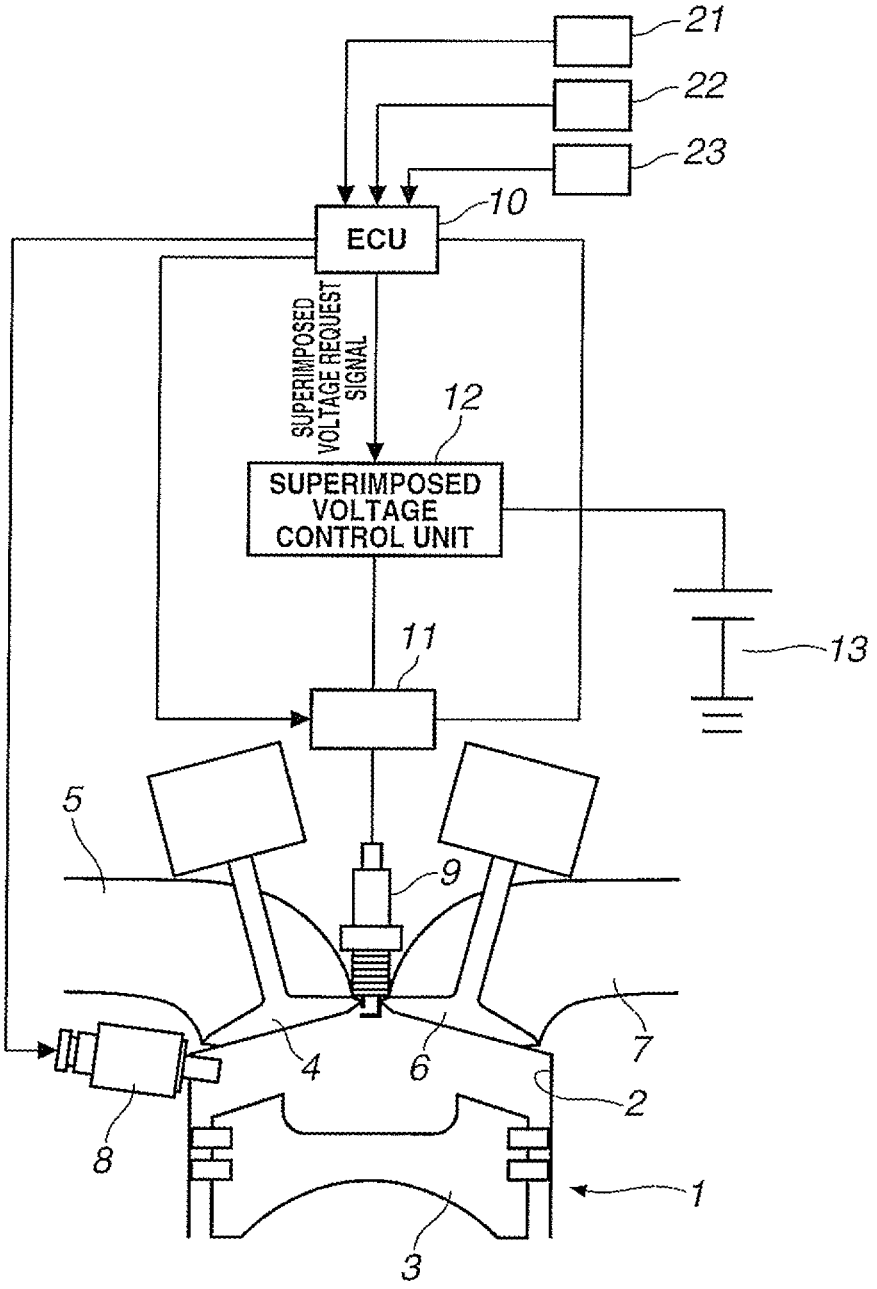
FIG. 1 is an illustration showing a construction of an internal combustion engine equipped with an ignition device of a first embodiment of the present invention.

FIG. 1 is an illustration showing a system construction of an internal combustion engine 1 that is equipped with an ignition device of the present invention. In each of cylinders 2 of the internal combustion engine 1, there is arranged a piston 3, and to each cylinder, there are connected an intake port 5 that is opened/closed by an intake valve 4 and an exhaust port 7 that is opened/closed by an exhaust valve 6. Furthermore, a fuel injection valve 8 is arranged to inject fuel into the cylinder. Fuel injection timing and fuel injection amount of this fuel injection valve 8 are controlled by an engine control unit (ECU) 10. In order to ignite air/fuel mixture produced in the cylinder by the fuel injection valve 8, there is provided an ignition plug 9 that is arranged at for example a central part of a ceiling of the cylinder. Although, in the illustrated example, the engine is of a cylinder direct injection type internal combustion engine, the engine may be of a port injection type in which the fuel injection valve is arranged at the intake port 5. To the engine control unit 10, there are inputted detection signals from various sensors, such as an airflow meter 21 that detects an intake air amount, a crank angle sensor 22 that detects an engine rotation speed, a temperature sensor 23 that detects the temperature of engine cooling water, etc.

To the ignition plug 9, there is connected an ignition unit 11 that outputs to the ignition plug 9 a discharge voltage in response to an ignition signal outputted from the engine control unit 10. Furthermore, there is provided a superimposed voltage control unit 12 that controls a superimposed voltage provided by the ignition unit 11 in response to a superimposed voltage request signal outputted from the engine control unit 10. The engine control unit 10, the ignition unit 11 and the superimposed voltage control unit 12 are all connected to a 14-volt battery 13 mounted on a motor vehicle.

Figure 2:
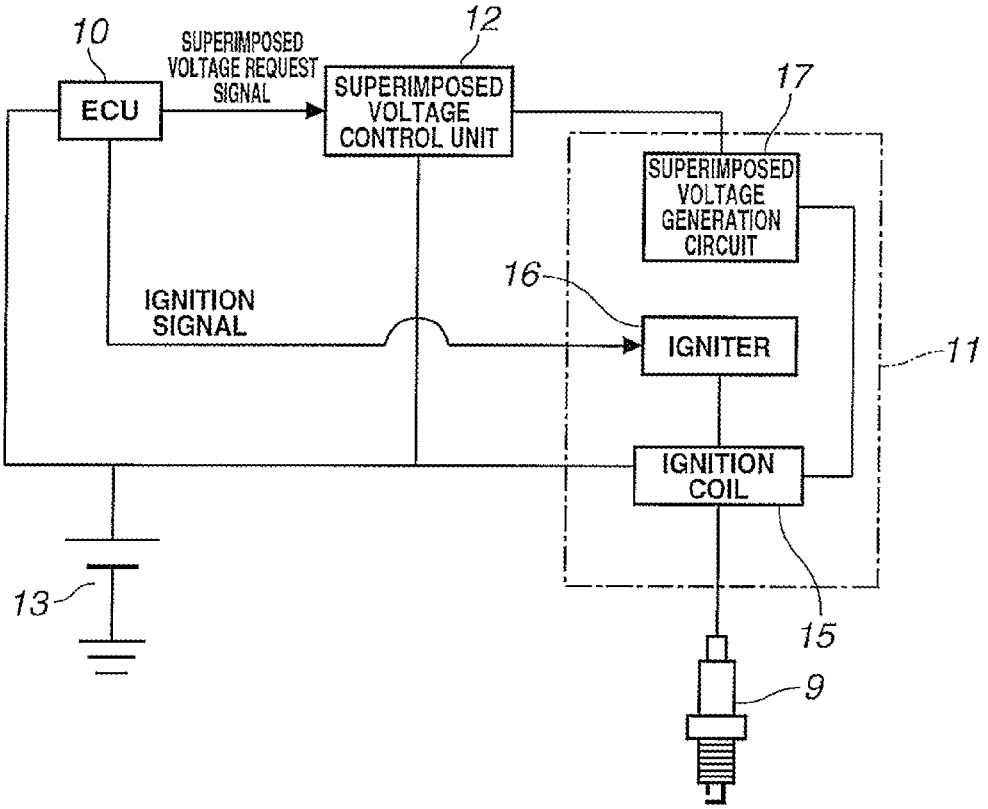
FIG. 2 is an illustration showing a construction of the ignition device.
Figure 3:
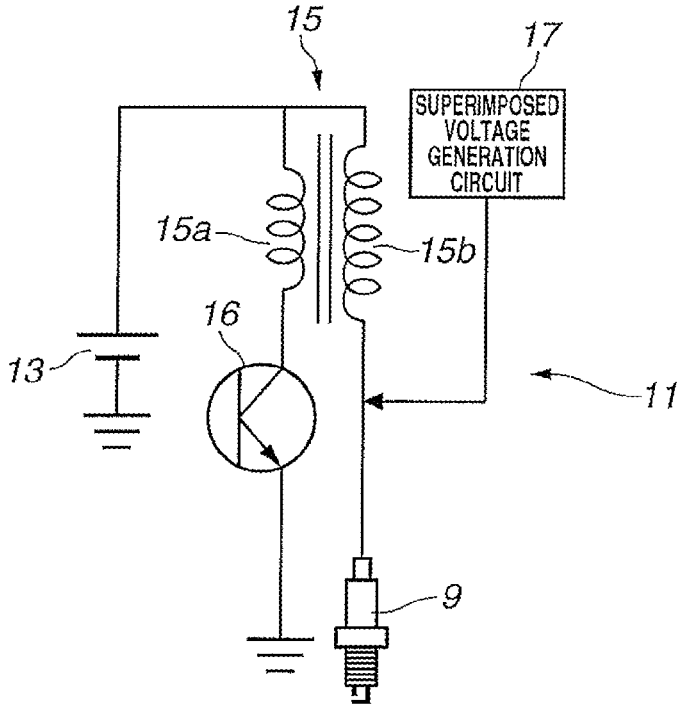
FIG. 3 is an illustration showing an essential portion of the ignition device.

As is shown in FIGS. 2 and 3 in detail, the ignition unit 11 includes an ignition coil 15 that has both a primary coil 15*a* and a secondary coil 15*b*, an igniter 16 that controls feeding/shutting off of primary current to the primary coil 15*a* of the ignition coil 15 and a superimposed voltage generation circuit 17 that has a booster circuit installed. To the secondary coil 15*b* of the ignition coil 15, there is connected the ignition plug 9. After boosting the voltage of the battery 13 to the level of a predetermined superimposed voltage, the superimposed voltage generation circuit 17 outputs a superimposed voltage to the ignition plug 9 after starting of discharge of the ignition plug 9 based on a control signal from the superimposed voltage control unit 12. The superimposed voltage generation circuit 17 functions to generate a superimposed voltage in the same potential direction as a desired discharge voltage that is produced between electrodes of the ignition plug 9 at the time when feeding of the primary current to the primary coil 15*a* is cut off.

Figure 4:
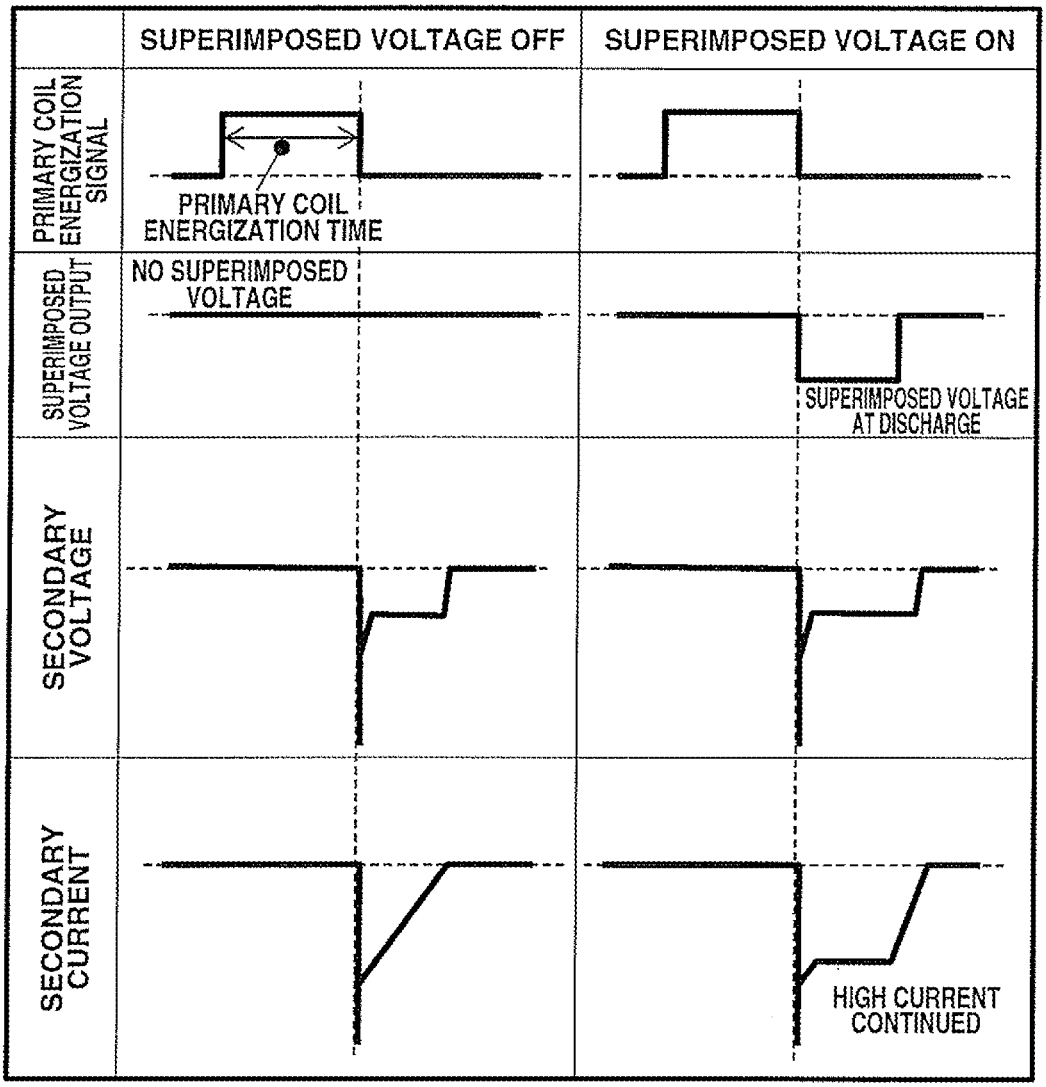
FIG. 4 is an illustration showing waveforms of a secondary voltage etc., at times when superimposed voltage is not fed and fed.

FIG. 4 is an illustration explaining a change of a secondary current (discharge current) in case where the superimposed voltage is present or not, that is, illustrating respective waveforms of primary currents (primary coil energization signals), superimposed voltages, secondary voltages and secondary currents in both cases where the superimposed voltage is not fed and fed.

In case where the superimposed voltage is not fed, the same operation as that in a general ignition device is carried out. That is, during a predetermined energization time TDWL, the primary current is fed to the primary coil 15*a* of the ignition coil 15 through the igniter 16. In response to the cutting off of the primary current, the secondary coil 15*b* is forced to produce a high discharge voltage and an electric discharge is produced between the electrodes of the ignition plug 9 in response to insulation breakdown of air/fuel mixture. The secondary current flowing between the electrodes is relatively rapidly reduced in a triangular waveform with a lapse of time from starting of the electric discharge.

While, in case where the superimposed voltage is fed, feeding of the superimposed voltage is started at substantially the same time as the cutting off of the primary current, and during a given time, a superimposing of a certain superimposed voltage is carried out. With this, for a relatively long time from the starting of electric discharge, the secondary current is kept at a higher level.

Figure 5:
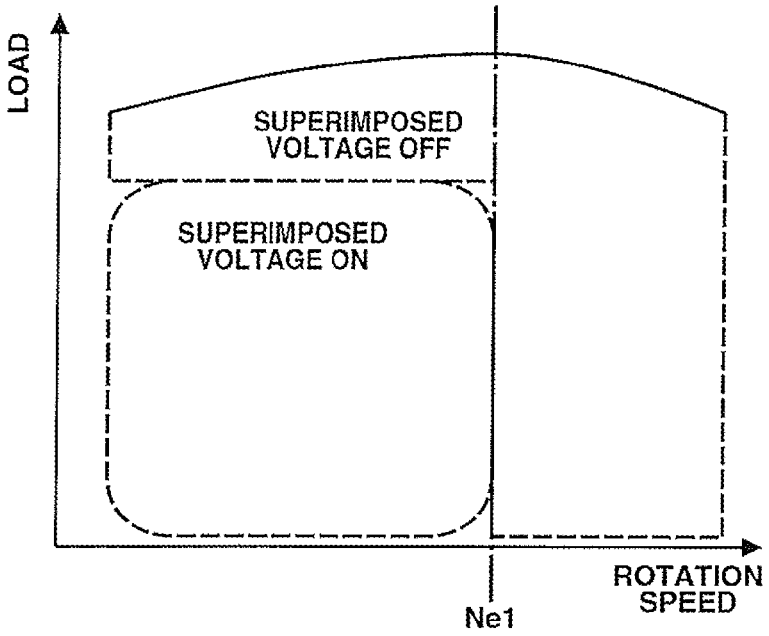
FIG. 5 is a characteristic diagram showing an operation range in which feeding of superimposed voltage is carried out in the first embodiment.

In a first embodiment of the present invention, in accordance with an operation range determined by a load and a rotation speed of the internal combustion engine 1, it is determined whether feeding of the superimposed voltage is carried out or not. As is seen from FIG. 5, in an operation range where the engine rotation speed is equal to or smaller than a certain engine rotation speed Ne1 and the engine load is equal to or smaller than a certain degree, feeding of the superimposed voltage is carried out. This operation range corresponds to a range where ignitability of air/fuel mixture is relatively poor, and by feeding the superimposed voltage, the ignitability is improved. In other operation range, that is, an operation range of higher engine rotation speed and higher load, feeding of the superimposed voltage is not carried out.

In the first embodiment, in order to suppress temperature increase of the ignition unit 11 caused by the feeding of the superimposed voltage, the energization time TDWL for which the energization of the primary coil 15*a* is suitably controlled depending on whether feeding of the superimposed voltage is carried out or not.

Figure 6:
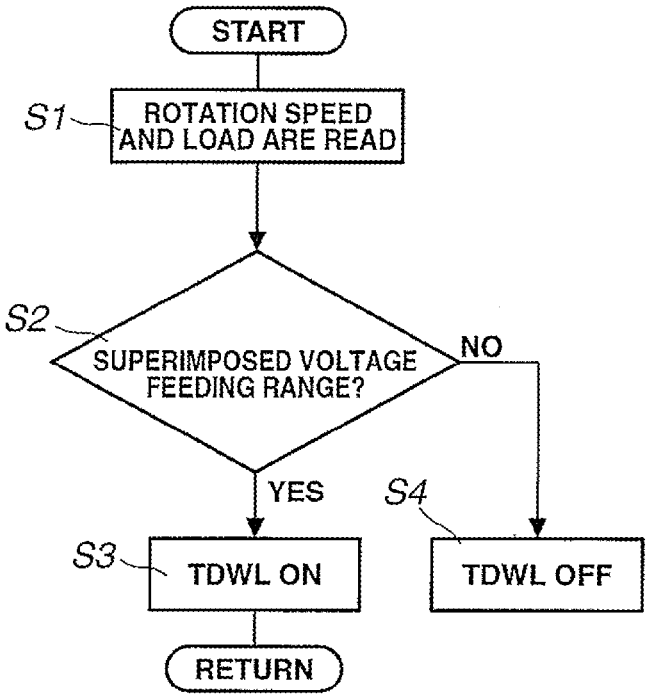
FIG. 6 is a flowchart used in the first embodiment.

FIG. 6 is a flowchart for carrying out switching of the energization time TDWL. At step 1, a rotation speed and a load of the internal combustion engine 1 are read, at step 2, judgment is carried out as to whether or not the engine rotation speed and the engine load, which were read at step 1, are within a superimposed voltage feeding range depicted by FIG. 5. If the operation range is judged to be a range that needs the superimposed voltage, an energization time TDWLON for the superimposed voltage feeding is selected as the energization time TDWL for the primary coil 15*a* (step 3), and if the operation range is judged to be a range that does not need the superimposed voltage, an energization time TDWLOFF for the superimposed voltage non-feeding is selected (step 4).

Figure 7:
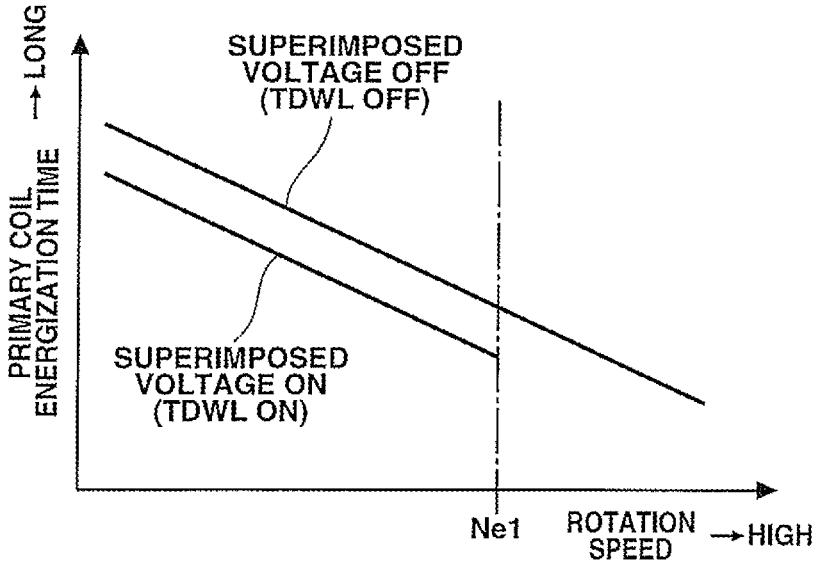
FIG. 7 is a characteristic diagram showing a characteristic of an energization time for a primary coil at the time when feeding of superimposed voltage is carried out.

FIG. 7 shows a characteristic of the energization time TDWLON for the superimposed voltage feeding and a characteristic of the energization time TDWLOFF for the superimposed voltage non-feeding. As is shown, these energization times are determined based on the rotation speed of the internal combustion engine 1, and basically, these energization times have such a characteristic that the energization time reduces as the engine rotation speed increases. Furthermore, the energization time TDWLON for the superimposed voltage feeding is set to be shorter than the energization time TDWDOFF for the superimposed voltage non-feeding by a given degree of time. If desired, as a table on which values are allocated relative to the engine rotation speed, two types of table may be provided, one being a table for the energization time for the superimposed voltage feeding and the other being a table for the energization time for the superimposed voltage non-feeding. Or, if desired, only the table for the energization time TDWDOFF for the superimposed voltage non-feeding may be provided, and by correcting a value read from the table, the energization time TDWDON for the superimposed value feeding may be obtained.

As is mentioned hereinabove, by reducing the energization time TDWL for the primary coil 15*a* at the time of feeding the superimposed voltage, the temperature increase of the ignition unit 11, which would be caused by the feeding of the superimposed voltage, can be suppressed. As is shown in FIG. 4, in case where feeding of the superimposed voltage is not carried out, the period of the secondary current, or the discharge energy given to air/fuel mixture depends on the time for which the primary coil 15*a* is kept energized. However, in case of feeding the superimposed voltage, the secondary current is continued by the superimposed voltage and thus a larger discharge energy is given. Thus, although a minimum required energization time has to be prepared for producing the insulation breakdown, there is no need of preparing energization time that is equal to or longer than the minimum required time. While, in case of feeding no superimposed voltage, the energization time TDWL for the primary coil 15*a* is relatively long, and thus, the discharge energy becomes large. Accordingly, in this embodiment, a high ignition performance is obtained in the entire engine operation range while avoiding the temperature increase of the ignition unit 11.

Figure 8:
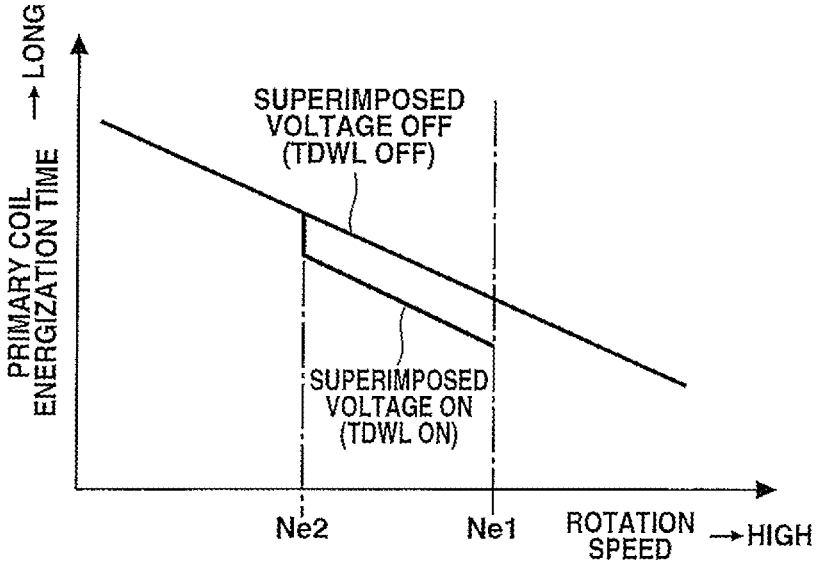
FIG. 8 is a characteristic diagram showing another example of the characteristic of the energization time for the primary coil at the time when feeding of superimposed voltage is carried out.

FIG. 8 shows another example of the characteristic of the energization time TDWLON for the superimposed voltage feeding. As is seen from this graph, in this example, even when the engine rotation speed and the engine load are within the superimposed voltage feeding range, in a low engine rotation speed range that is set lower than a certain engine rotation speed Ne2, the energization time TDWLON for the superimposed voltage feeding is the same as the energization time TDWLOFF for the superimposed voltage non-feeding. That is, only when, in the superimposed voltage feeding range, the engine rotation speed is in a range equal to or higher than the engine rotation speed Ne2, the energization time TDWLON is shorter than the energization time TDWLOFF for the superimposed voltage non-feeding. This is a result of considering that in the range of a lower engine rotation speed side, the temperature increase of the ignition unit 11 does not bring about severe problems.

Figure 9:
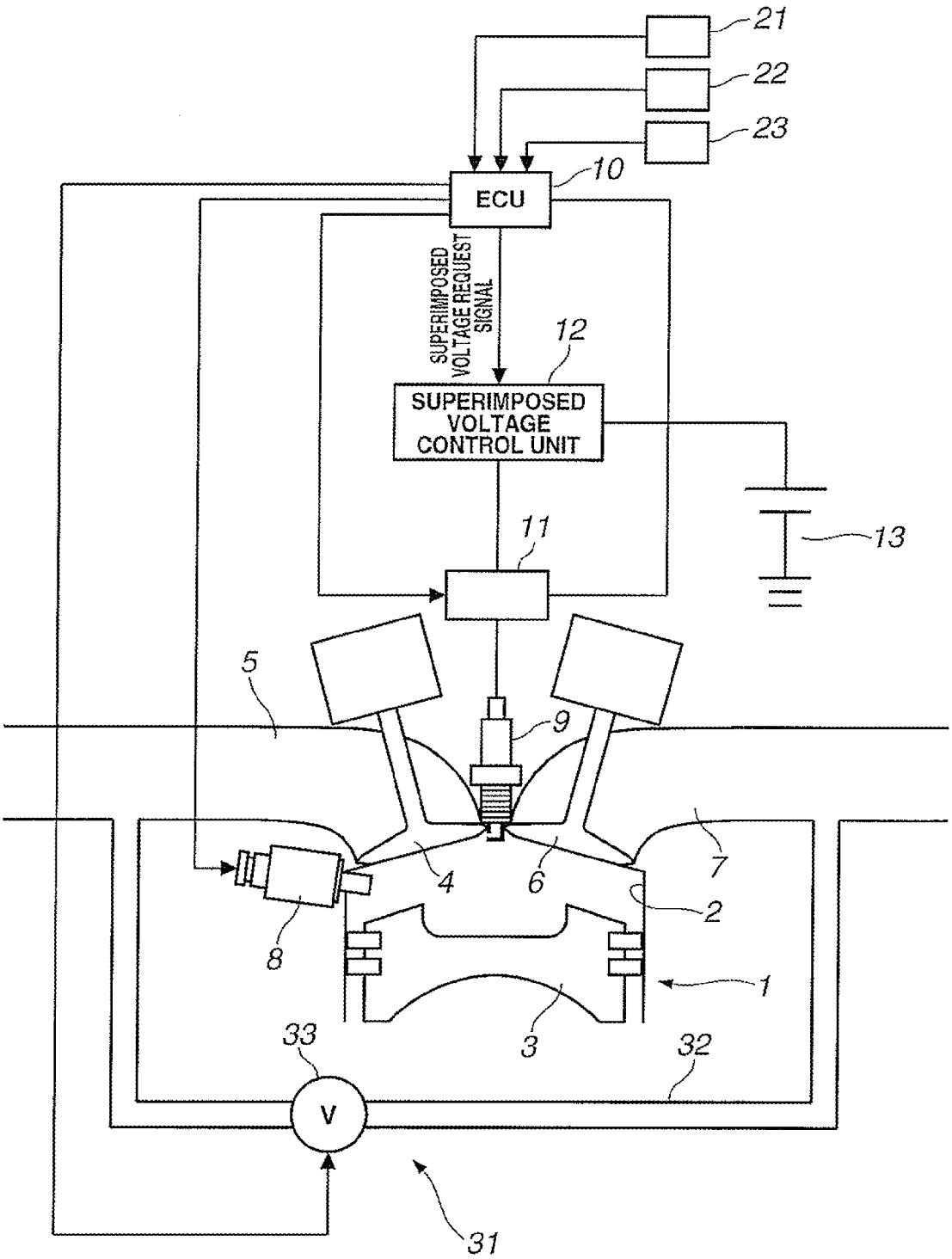
FIG. 9 is an illustration showing a construction of an internal combustion engine in a second embodiment.

In the following, a second embodiment of the present invention will be explained with reference to FIGS. 9 to 11. As is seen from FIG. 9, in this embodiment, in order to improve fuel consumption, there is employed an exhaust gas recirculation device 31 that consists of an exhaust gas recirculation passage 32 extending from an exhaust system to an intake system and an exhaust gas recirculation control valve 33. As is known to those skilled in the art, by introducing a relatively large amount of recirculated exhaust gas (EGR) into combustion chambers, improvement of the fuel consumption is obtained due to lowering of pumping loss. However, due to the EGR introduction, the ignitability by the ignition plug 9 is lowered. Accordingly, in this embodiment, at the time of the EGR introduction, the superimposed voltage feeding is carried out for assuring the ignitability. If the EGR introduction is carried out when the internal combustion engine 1 is not sufficiently warmed up, combustion becomes unstable. Accordingly, in case where an engine temperature, such as cooling water temperature detected by a temperature sensor 23 and/or lubricant oil temperature detected by a lubricant oil temperature sensor (not shown), is lower than a predetermined threshold value (Tmin), the EGR introduction is inhibited.

Figure 10:
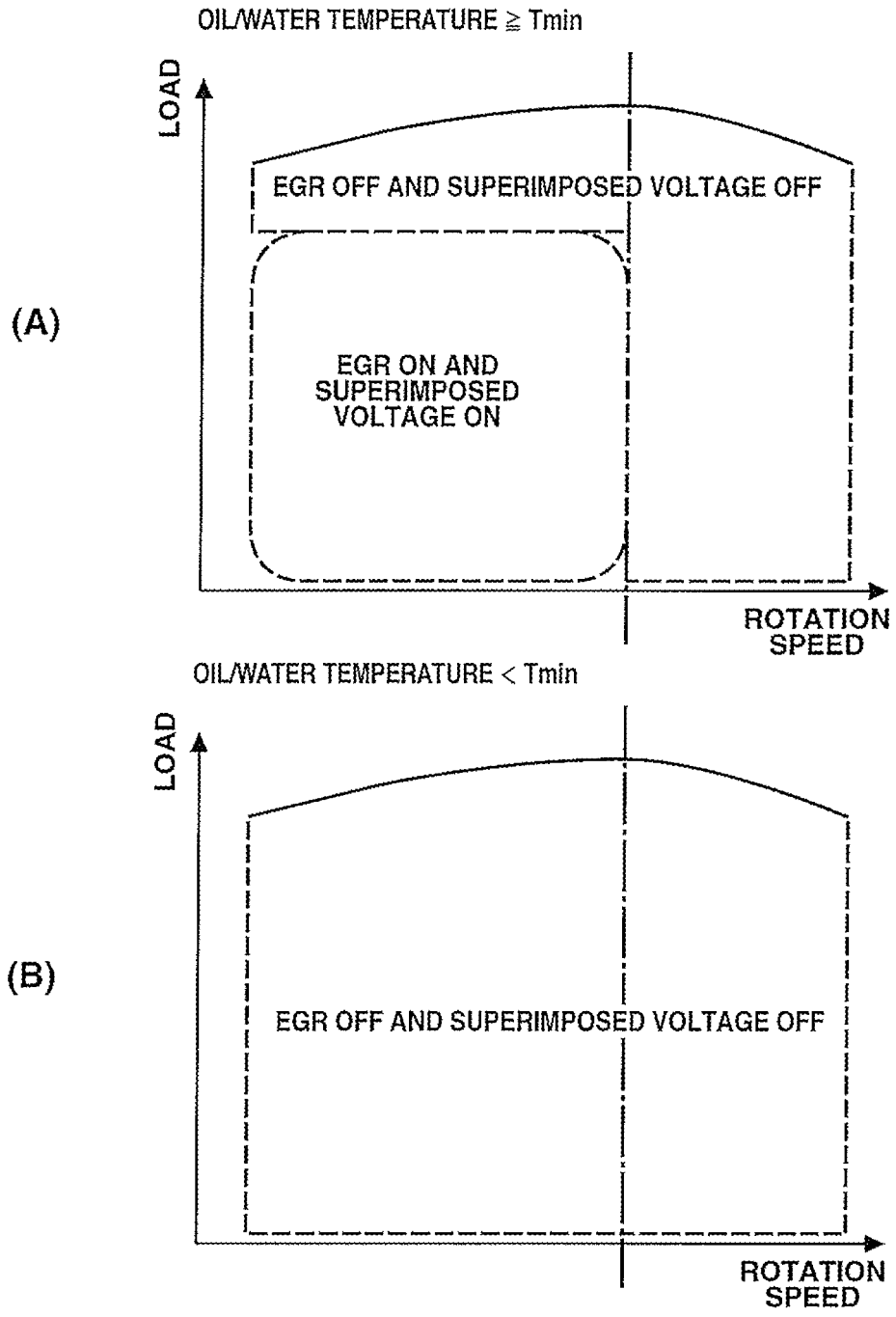
FIG. 10 provides characteristic diagrams each showing an operation range in which both introduction of EGR and feeding of superimposed voltage are carried out in the second embodiment, in which (A) shows a characteristic that appears after the engine is warmed up and (B) shows a characteristic that appears when the engine is not warmed up yet.

(A) of FIG. 10 shows an EGR introduction range (which just means a superimposed voltage feeding range) that is set when the engine is in a warmed up condition where the engine temperature (lubricant oil/water temperature) is equal to or higher than the value Tmin. As is seen from the figure, in a condition where the warming up of the internal combustion engine 1 is completed, the EGR introduction and feeding of the superimposed voltage are carried out in a range where the engine rotation speed is equal to or lower than a predetermined speed and the load is equal to or lower than a predetermined degree. In other range that is a range of a higher engine rotation speed or a range of a higher engine load, the EGR introduction is inhibited and at the same time feeding of the superimposed voltage is not carried out.

(B) of FIG. 10 shows a non-warmed up condition where the engine temperature is lower than the value Tmin. In this condition, the EGR introduction and the feeding of the superimposed voltage are not carried out without considering the rotation speed and load of the engine. That is, in the internal combustion engine 1 of this embodiment, in accordance with the temperature condition of the internal combustion engine 1, switching is carried out between a first type of combustion that does not accompany the EGR introduction and a second type of combustion that accompanies the EGR introduction.

Figure 11:
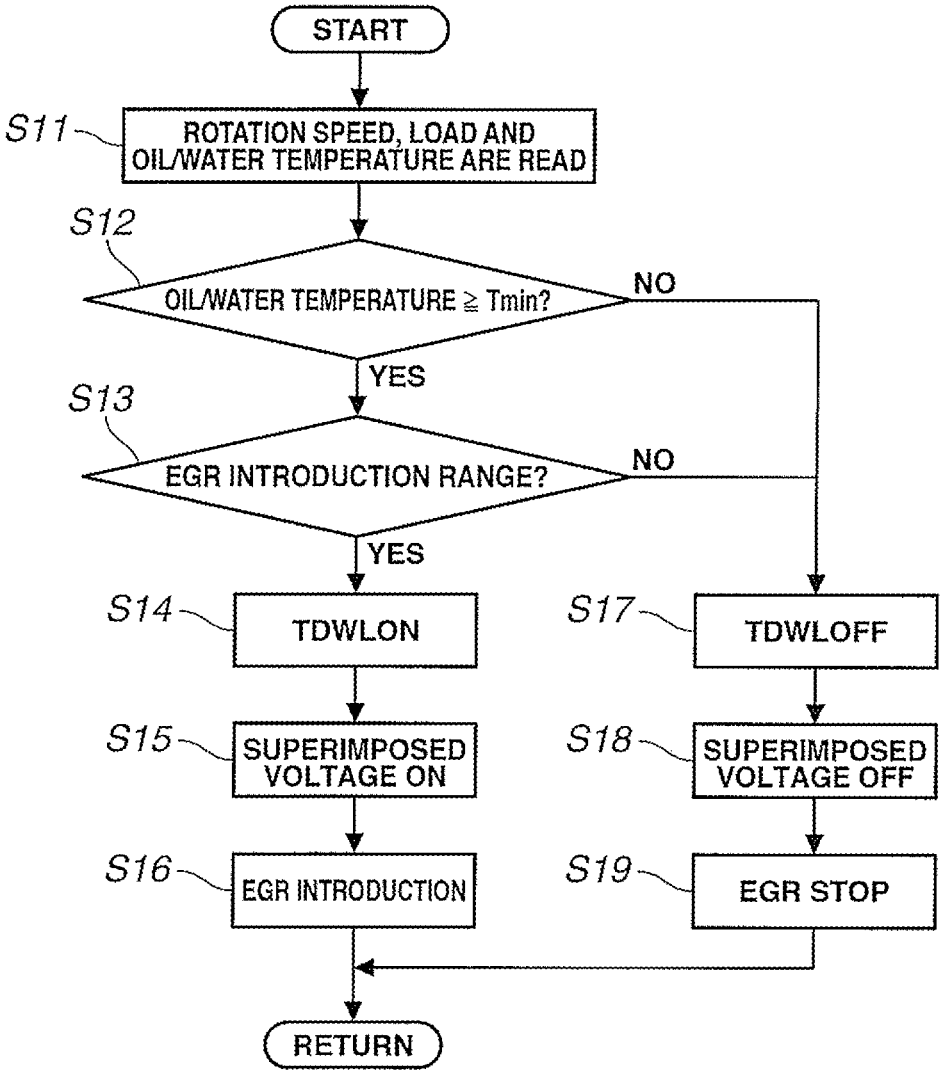
FIG. 11 is a flowchart used in the second embodiment.

FIG. 11 shows a flowchart used in the second embodiment. At step 11, a rotation speed and a load of the internal combustion engine, a load and a temperature (cooling water temperature and/or lubricant oil temperature) are read, and at step 12, judgment is carried out as to whether or not the engine temperature is equal to or higher than a threshold value Tmin. If the engine temperature is equal to or higher than the value Tmin, judgment is carried out in step 13 as to whether or not the rotation speed and load of the engine are within the EGR introduction range (or superimposed voltage feeding range) that is shown in FIG. 10(A). If it is judged that the rotation speed and load of the engine are within the EGR introduction range, the energization time TDWLON for the superimposed voltage feeding is selected (step 14) as the energization time TDWL for the primary coil 15*a*, and feeding of the superimposed voltage and the EGR introduction are carried out (steps 15 and 16).

When in step 12 it is judged that the engine temperature is lower than the value Tmin and in step 13 it is judged that the rotation speed and load of the engine are outside the EGR introduction range, the operation flow goes to step 17, and at this step, the energization time TDWLOFF for the superimposed voltage non-feeding is selected, and the feeding of the superimposed voltage and the EGR introduction are inhibited (steps 18 and 19).

The characteristic of the energization time TDWLOFF for the superimposed voltage non-feeding and the characteristic of the energization time TDWLON for the superimposed voltage feeding are the same as those shown in FIGS. 7 and 8. That is, basically, the energization time reduces as the rotation speed of the engine increases. In the example of FIG. 7, throughout the entire range of the rotation speed of the engine in the superimposed voltage feeding range (EGR introduction range), the energization time TDWLON for the superimposed voltage feeding is set shorter than the energization time TDWLOFF for the superimposed voltage non-feeding. While, in the example of FIG. 8, only in the higher engine rotation speed side in the superimposed voltage feeding range (EGR introduction range), the energization time TDWLON for the superimposed voltage feeding is set shorter than the energization time TDWLOFF for the superimposed voltage non-feeding.

In the above-mentioned second embodiment, for the EGR introduction, a so-called external exhaust gas recirculation device including the exhaust gas recirculation passage 32 is used. However, in the invention, for the EGR introduction, a so-called internal exhaust gas recirculation device provided by controlling a valve overlap between an intake valve 4 and an exhaust valve 6 can be used.

In the following, a third embodiment of the present invention will be explained with reference to FIGS. 12 and 13. In this third embodiment, for improving the fuel consumption, a lean combustion is carried out by increasing air/fuel ratio. Also in this lean combustion, although the fuel consumption is improved, the ignitability by the ignition plug 9 is lowered. Thus, in this third embodiment, feeding of the superimposed voltage is timely carried out. However, when the internal combustion engine 1 is not sufficiently warmed up and thus the temperature of the engine is low, the lean combustion brings about unstable combustion. Accordingly, when the engine is not sufficiently warmed up, the lean combustion and the superimposed voltage feeding are not carried out.

Figure 12:
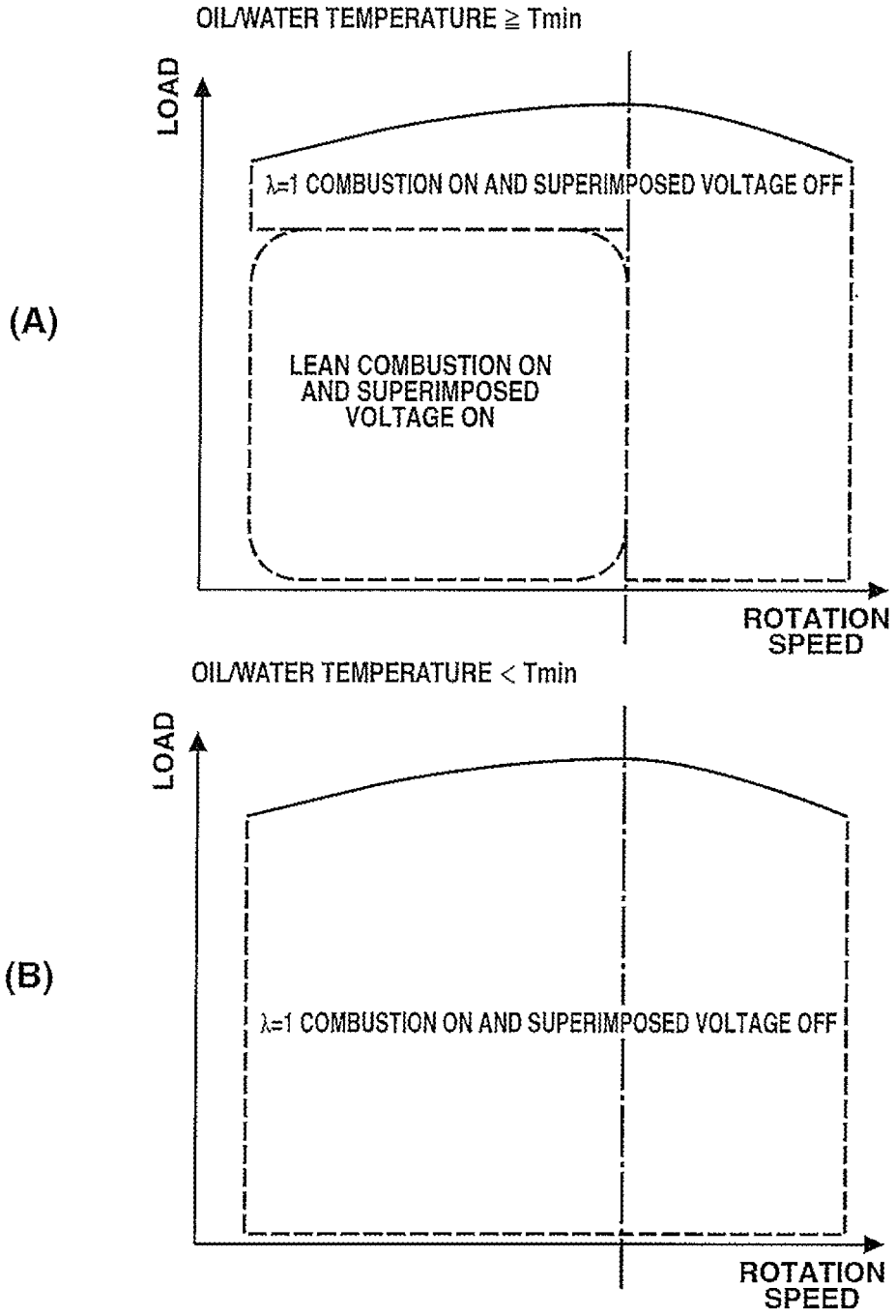
FIG. 12 provides characteristic diagrams each showing an operation range in which both lean combustion and feeding of superimposed voltage are carried out in a third embodiment, in which (A) shows a characteristic that appears after the engine is warmed up and (B) shows a characteristic that appears when the engine is not warmed up yet.

(A) of FIG. 12 shows a lean combustion range (which just means a superimposed voltage feeding range) that is set when the engine is in a warmed up condition where the engine temperature (lubricant oil/water temperature) is equal to or higher than the value Tmin. As is seen from the figure, in a condition where the warming up of the internal combustion engine 1 is completed, the lean combustion and feeding of the superimposed voltage are carried out in a range where the engine rotation speed is equal to or lower than a predetermined speed and the engine load is equal to or lower than a predetermined degree. In other range that is a range of a higher engine rotation speed or a range of a higher engine load, a combustion effected by a stoichiometric air/fuel ratio is carried out and feeding of the superimposed voltage is not carried out.

(B) of FIG. 12 shows a non-warmed up condition where the engine temperature is lower than the value Tmin. In this condition, the lean combustion is inhibited, the combustion effected by the stoichiometric air/fuel ratio is carried out and feeding of the superimposed voltage is not carried out without considering the engine rotation speed and the engine load. That is, in the internal combustion engine 1 of this embodiment, in accordance with the temperature condition of the internal combustion engine 1, switching is carried out between a first type of combustion that is a combustion effected by a stoichiometric air/fuel ratio and a second type of combustion that is a lean combustion effected by a stratified air intake.

Figure 13:
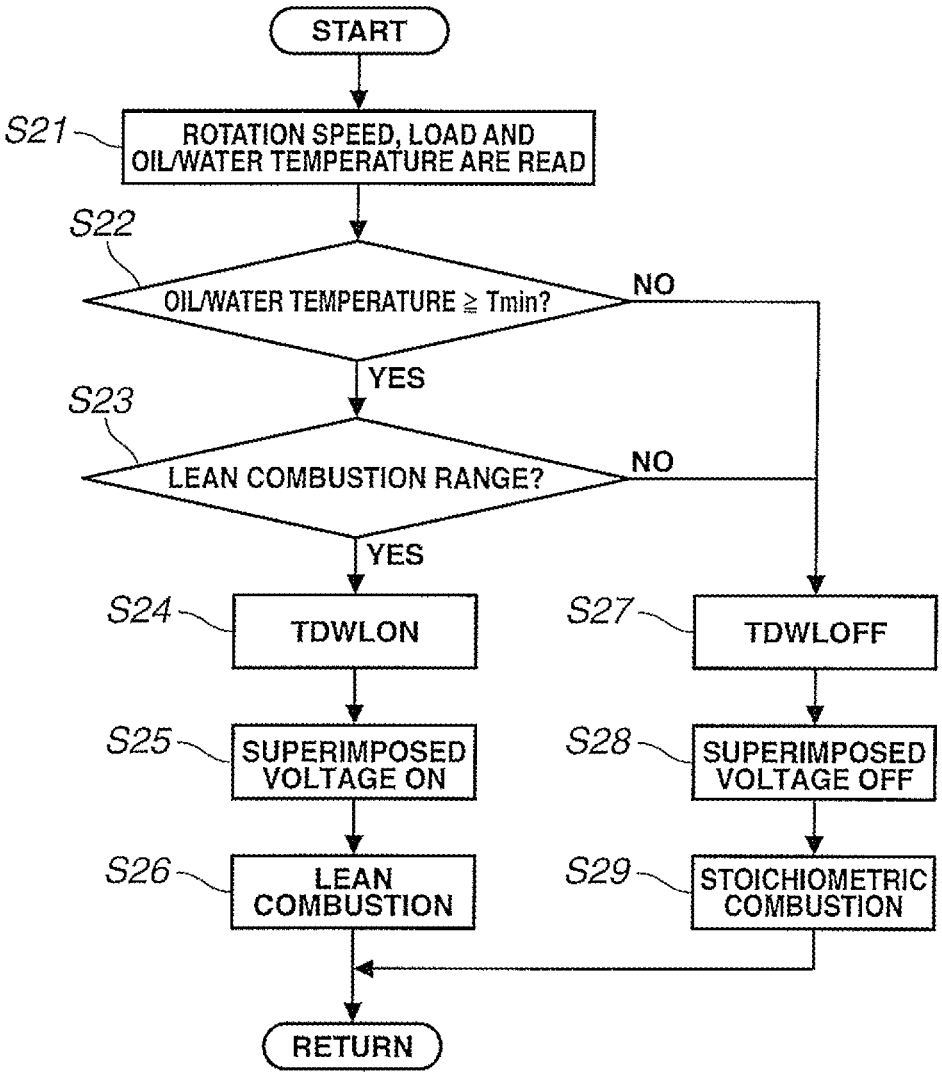
FIG. 13 is a flowchart used in the third embodiment.

FIG. 13 shows a flowchart used in the third embodiment. At step 21, the rotation speed, load and temperature (cooling water temperature and lubricant oil temperature) of the internal combustion engine 1 are read, and at step 22, judgment is carried out as to whether or not the engine temperature is equal to or higher than the threshold value Tmin. If the engine temperature is judged equal to or higher than the value Tmin, judgment is carried out in step 23 as to whether or not the engine rotation speed and engine load are within a lean combustion range (superimposed voltage feeding range) that is shown in FIG. 12(A). If it is judged that the engine rotation speed and the engine load are within the lean combustion range, the energization time TDWLON for the superimposed voltage feeding is selected (step 24) as the energization time TDWL for the primary coil 15*a*, and feeding of the superimposed voltage and the lean combustion are carried out (steps 25 and 26).

When in step 22 it is judged that the engine temperature is lower than the value Tmin and when in step 23 it is judged that the engine rotation speed and the engine load are outside the lean combustion range, the operation flow goes to step 27, and at this step, the energization time TDWLOFF for the superimposed voltage non-feeding is selected, and feeding of the superimposed voltage is inhibited and a combustion (stoichiometric combustion) effected by a stoichiometric air/fuel ratio is carried out (steps 28 and 29).

The characteristic of the energization time TDWLOFF for the superimposed voltage non-feeding and the characteristic of the energization time TDWLON for the superimposed voltage feeding are the same as those shown in FIGS. 7 and 8.

Figure 14:
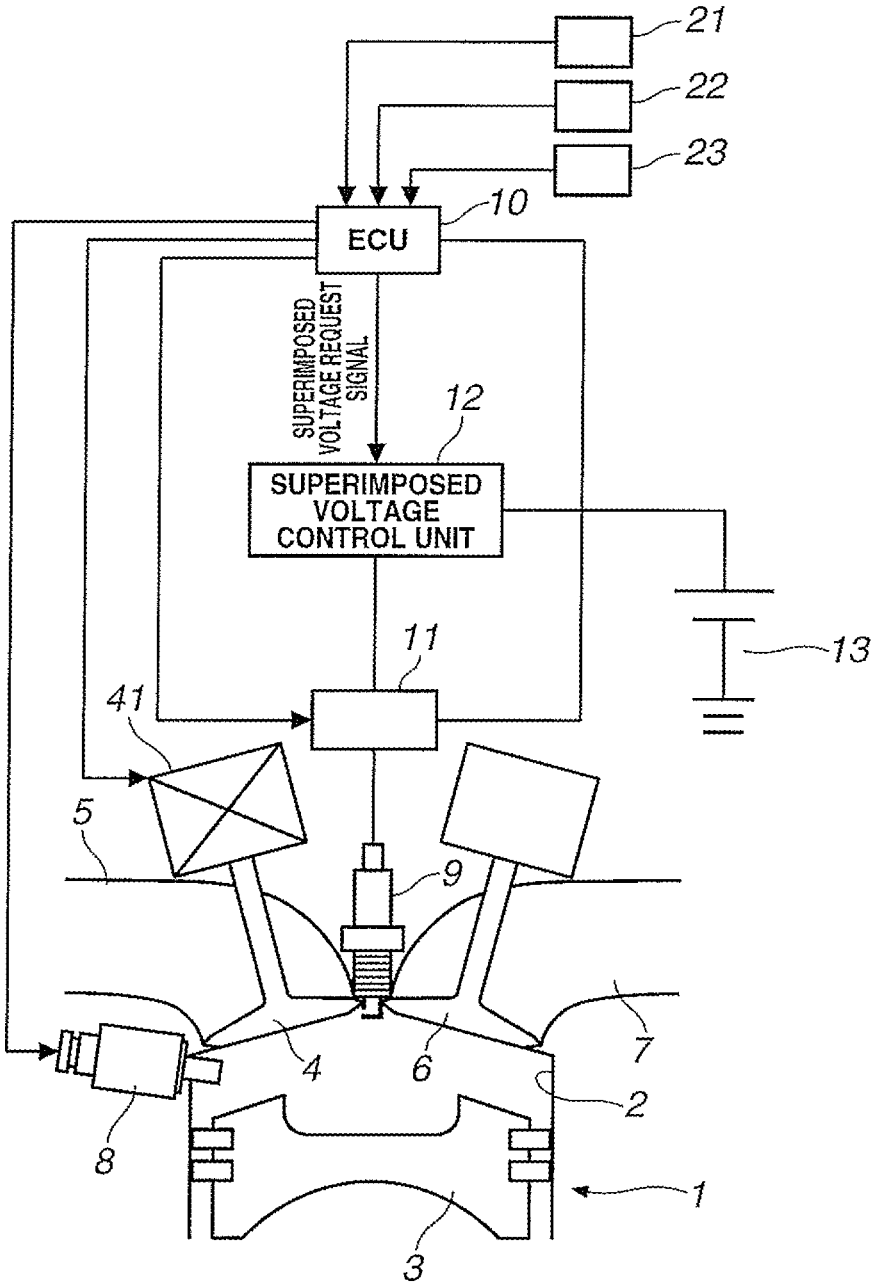
FIG. 14 is an illustration showing a construction of an internal combustion engine in a fourth embodiment.

In the following, a fourth embodiment of the present invention will be explained with reference to FIGS. 14 to 16. In this fourth embodiment, for improving the fuel consumption, a Miller cycle combustion is carried out. As is shown in FIG. 14, the internal combustion engine 1 is equipped with a variable valve operation mechanism 41 that is able to vary a close timing of the intake valve 4. As is known to those skilled in the art, a fuel consumption is improved by carrying out a Miller cycle combustion, such as a quick closing Miller cycle combustion wherein the close timing of an intake valve is greatly advanced relative to the bottom dead center and/or a retarded closing Miller cycle combustion wherein the close timing of the intake valve is greatly retarded relative to the bottom dead center. However, in such combustion, the ignitability by the ignition plug 9 is lowered. Accordingly, in this embodiment, feeding of the superimposed voltage is timely carried out. However, when the internal combustion engine 1 is not sufficiently warmed up and thus the engine temperature is low, the Miller cycle combustion brings about unstable combustion. Accordingly, when the engine is not sufficiently warmed up, the Miller cycle combustion and the superimposed voltage feeding are not carried out.

Figure 15:
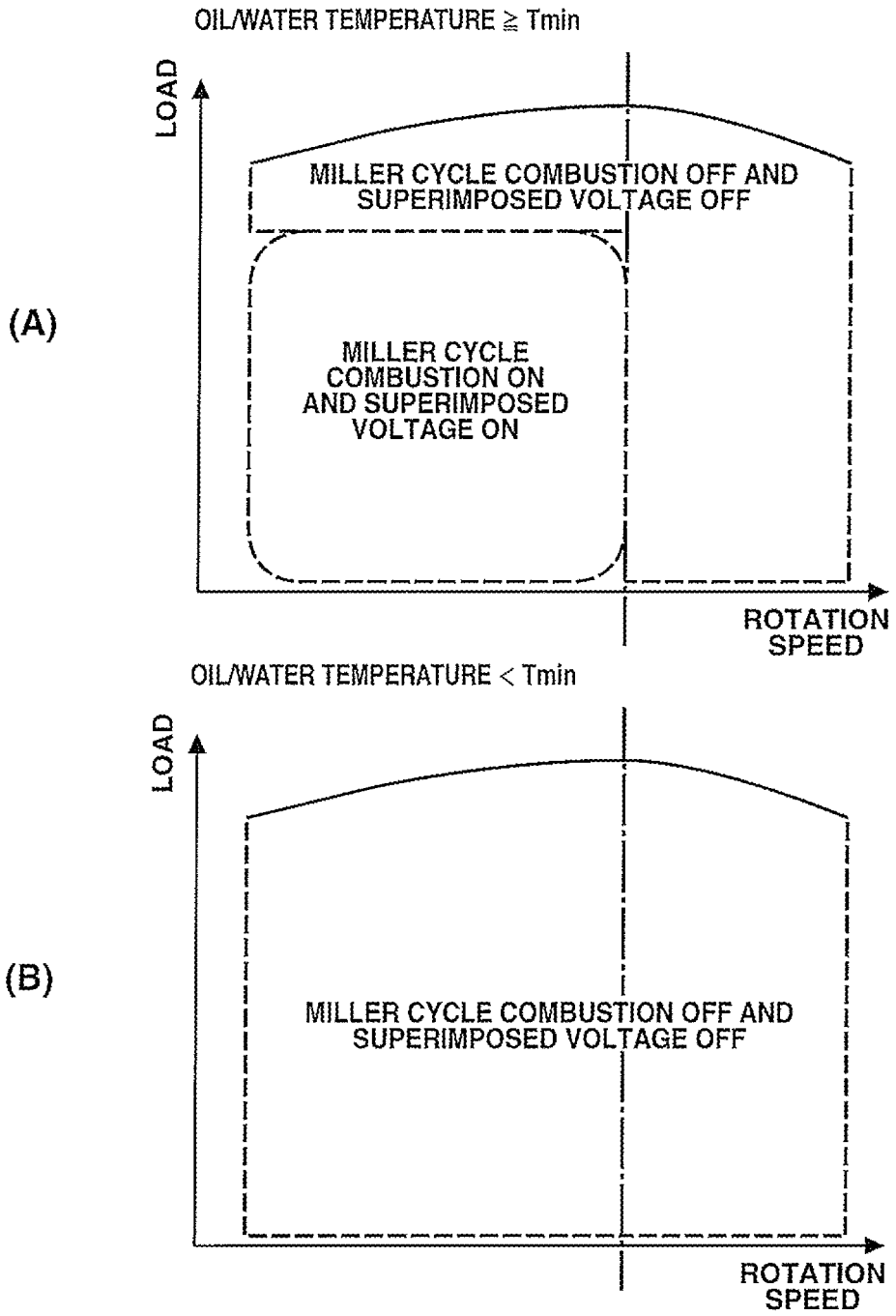
FIG. 15 provides characteristic diagrams each showing an operation range in which both Miller cycle combustion and feeding of superimposed voltage are carried out in the fourth embodiment, in which (A) shows a characteristic that appears after the engine is warmed up and (B) shows a characteristic that appears when the engine is not warmed up yet.

(A) of FIG. 15 shows a Miller cycle combustion range (which just means a superimposed voltage feeding range) that is set when the engine is in a warmed up condition where the engine temperature (lubricant oil/water temperature) is equal to or higher than the value Tmin. As is seen from the figure, in a condition where the warming up of the internal combustion engine 1 is completed, the Miller cycle combustion and feeding of the superimposed voltage are carried out in a range where the engine rotation speed is equal to or lower than a predetermined speed and the engine load is equal to or lower than a predetermined degree. In other range that is a range of a higher engine rotation speed or a range of a higher engine load, non-Miller cycle combustion effected by shifting the intake valve close timing close to the bottom dead center is carried out and the superimposed voltage feeding is not carried out.

(B) of FIG. 15 shows a non-warmed up condition where the engine temperature is lower than the value Tmin. In this condition, the Miller cycle combustion is inhibited without considering the engine rotation speed and engine load, non-Miller cycle combustion effected by shifting the intake valve close timing close to the bottom dead center is carried out and the superimposed voltage feeding is not carried out. That is, in the internal combustion engine of this embodiment, in accordance with the temperature condition of the internal combustion engine 1, switching is carried out between a first type of combustion that is a normal combustion effected by shifting the intake valve close timing close to the bottom dead center and a second type of combustion that is the Miller cycle combustion effected by advancing or retarding the intake valve close timing.

Figure 16:
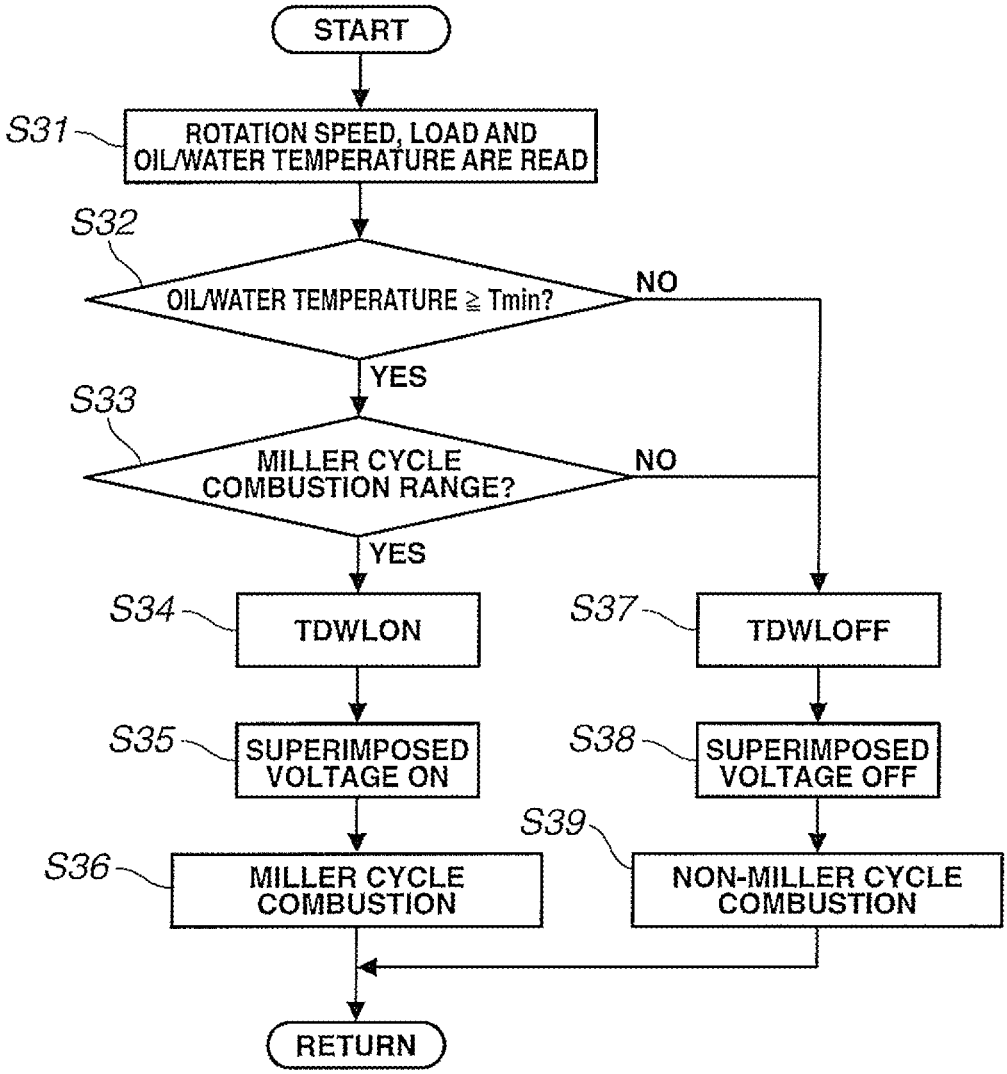
FIG. 16 is a flowchart used in the fourth embodiment.

FIG. 16 shows a flowchart used in the fourth embodiment. At step 31, the rotation speed, load and temperature (cooling water temperature and lubricant oil temperature) of the internal combustion engine 1 are read, and at step 32, judgment is carried out as to whether or not the engine temperature is equal to or higher than the threshold value Tmin. If the engine temperature is judged equal to or higher than the value Tmin, judgment is carried out at step 33 as to whether or not the engine rotation speed and engine load are within the Miller cycle combustion range (superimposed voltage feeding range) that is shown in FIG. 15(A). If it is judged that the engine rotation speed and engine load are within the Miller cycle combustion range, the energization time TDWLON for the superimposed voltage feeding is selected (step 34) as the energization time TDWL for the primary coil 15*a*, and feeding of the superimposed voltage and the Miller cycler combustion are carried out (steps 35 and 36).

When in step 32 it is judged that the engine temperature is lower than the value Tmin and when in step 33 it is judged that the engine rotation speed and the engine load are outside the Miller cycle combustion range, the operation flow goes to step 37, and at this step, the energization time TDWLOFF for the superimposed voltage non-feeding is selected, and feeding of the superimposed voltage is inhibited and the non-Miller cycle combustion is carried out (steps 38 and 39).

The characteristic of the energization time TDWLOFF for the superimposed voltage non-feeding and the characteristic of the energization time TDWLON for the superimposed voltage feeding are the same as those shown in FIGS. 7 and 8.

The invention claimed is:

1. An ignition device of an internal combustion engine that produces a discharge voltage between electrodes of an ignition plug connected to a secondary coil of an ignition coil by feeding and cutting off a primary current to a primary coil of the ignition coil, comprising:

a superimposed voltage generation circuit that continues a discharge current by, after starting the discharge by the secondary coil, feeding between the electrodes of the ignition plug a superimposed voltage of the same direction as the discharge voltage;

wherein under a given operation condition of the engine, the feeding of the superimposed voltage by the superimposed voltage generation circuit is carried out; and wherein an energization time for the primary coil set in accordance with an engine rotation speed has, as its characteristics a first characteristic selected when the superimposed voltage is not fed and a second characteristic selected when the superimposed voltage is fed, and the second characteristic has such a feature that the energization time is set relatively short.

2. An ignition device of an internal combustion engine as claimed in claim 1, in which:

in a range of engine rotation speed and engine load in which the feeding of the superimposed voltage is carried out, the second characteristic is selected only in a higher engine rotation speed side to shorten the energization time for the primary coil and in a lower engine rotation speed side, the first characteristic is selected to make the energization time equal to that provided when the feeding of the superimposed voltage is not carried out.

3. An ignition device of an internal combustion engine as claimed in claim 1, in which:

the internal combustion engine has such a construction that in the same engine rotation speed and engine load, in accordance with a given switching condition, switching is carried out between a first combustion mode and a second combustion mode ignitability of which is poor as compared with that of the first combustion mode; and the feeding of the superimposed voltage is carried out when the engine takes the second combustion mode.

4. An ignition device of an internal combustion engine as claimed in claim 3, in which:

the second combustion mode is either one of a combustion that is carried out with EGR introduction, a lean combustion and a Miller cycle combustion.

5. An ignition device of an internal combustion engine as claimed in claim 3, in which the switching condition is a temperature condition of the internal combustion engine.

6. An ignition method of an internal combustion engine that produces a discharge voltage between electrodes of an ignition plug connected to a secondary coil of an ignition coil by feeding and cutting of a primary current to a primary coil of the ignition coil, comprising:

continuing a discharge current by, after starting of the discharge by the secondary coil, feeding between the electrodes of the ignition plug a superimposed voltage of the same direction as the discharge voltage; and selecting, as characteristics of an energization time for the primary coil which is set in accordance with an engine rotation speed, a first characteristic when the superimposed voltage is not fed and selecting the second characteristic when the superimposed voltage is fed, the second characteristic having such a feature that the energization time is set relatively short.

7. An ignition device of an internal combustion engine as claimed in claim 1, further comprising a first table that plots the energization time relative to the engine rotation speed in accordance with the first characteristic and a second table that plots the energization time relative to the engine rotation speed in accordance with the second characteristic.

8. An ignition device of an internal combustion engine as claimed in claim 1, further comprising a table that plots the energization time relative to the engine rotation speed in accordance with the first characteristic, wherein upon feeding of the superimposed voltage, an energization time in accordance with the second characteristic is obtained by correcting data read from the table.

* * * * *